US010502033B2

(12) United States Patent
Saltel et al.

(10) Patent No.: US 10,502,033 B2
(45) Date of Patent: Dec. 10, 2019

(54) HYDRAULIC STIMULATION METHOD AND CORRESPONDING HYDRAULIC STIMULATION DEVICE

(71) Applicant: Saltel Industries, Bruz (FR)

(72) Inventors: Jean-Louis Saltel, Le Rheu (FR); Samuel Roselier, Le Rheu (FR)

(73) Assignee: SLATEL INDUSTRIES, Bruz (FR)

( * ) Notice: Subject to any disclaimer, the term of this patent is extended or adjusted under 35 U.S.C. 154(b) by 0 days.

(21) Appl. No.: 15/526,873

(22) PCT Filed: Oct. 16, 2015

(86) PCT No.: PCT/EP2015/073961
§ 371 (c)(1),
(2) Date: May 15, 2017

(87) PCT Pub. No.: WO2016/078840
PCT Pub. Date: May 26, 2016

(65) Prior Publication Data

US 2017/0321525 A1 Nov. 9, 2017

(30) Foreign Application Priority Data

Nov. 20, 2014 (FR) ..... 14 61268

(51) Int. Cl.
*E21B 43/10* (2006.01)
*E21B 43/26* (2006.01)
*E21B 43/16* (2006.01)

(52) U.S. Cl.
CPC ..... *E21B 43/103* (2013.01); *E21B 43/26* (2013.01); *E21B 43/162* (2013.01)

(58) Field of Classification Search
CPC ..... E21B 43/103; E21B 43/26; E21B 43/261; E21B 43/162; E21B 33/128; E21B 33/124
See application file for complete search history.

(56) References Cited

U.S. PATENT DOCUMENTS 4,605,074 A * 8/1986 Barfield ..... E21B 34/063 166/297
6,868,906 B1 * 3/2005 Vail, III ..... E21B 4/04 166/250.01

(Continued)

FOREIGN PATENT DOCUMENTS

FR 2996247 A1 4/2014
WO 2014124533 A1 8/2014

OTHER PUBLICATIONS

English translation of the Written Opinion of the International Searching Authority dated Jan. 7, 2016 for corresponding International Application No. PCT/EP2015/073961, filed Oct. 16, 2015.

(Continued)

*Primary Examiner* — Giovanna C Wright
*Assistant Examiner* — Yanick A Akaragwe
(74) *Attorney, Agent, or Firm* — David D. Brush; Westman, Champlin & Koehler, P.A.

(57) ABSTRACT

A method for hydraulic stimulation of rock of a borehole of a well having an internal casing. The method includes positioning a conduit in the casing, the conduit having along its external face expandable tubular sleeves, fixedly linked to the conduit, and at least one aperture before each sleeve placing the internal space of the conduit into communication with the space demarcated by the conduit and each sleeve. A fluid is injected into the conduit under a first pre-determined pressure, which is sufficient to expand the sleeves. For each of the areas of the wall of the well to be stimulated, the method includes: plugging the conduit downstream from a first area to be stimulated; perforating the wall of the conduit and, at least in certain cases, perforating the casing at the first area to be stimulated; and injecting a fluid into the conduit under a second stimulation pressure.

18 Claims, 8 Drawing Sheets

(56) References Cited

U.S. PATENT DOCUMENTS

| | | | | |
|---|---|---|---|---|
| 2012/0097398 | A1 | 4/2012 | Ravensbergen et al. | |
| 2012/0125619 | A1 | 5/2012 | Wood et al. | |
| 2014/0124199 | A1 | 5/2014 | Gorrara et al. | |
| 2015/0027724 | A1* | 1/2015 | Symms | E21B 23/06 166/373 |
| 2015/0252659 | A1 | 9/2015 | Saltel et al. | |
| 2016/0108711 | A1* | 4/2016 | Lynk | E21B 43/26 166/297 |

OTHER PUBLICATIONS

International Search Report dated Jan. 7, 2016 for corresponding International Application No. PCT/EP2015/073961, filed Oct. 16, 2015.

Written Opinion of the International Searching Authority dated Jan. 7, 2016 for corresponding International Application No. PCT/EP2015/073961, filed Oct. 16, 2015.

French Search Report and Written Opinion dated Jul. 7, 2015 for corresponding French Application No. 1461268, filed Nov. 20, 2014.

* cited by examiner

HYDRAULIC STIMULATION METHOD AND CORRESPONDING HYDRAULIC STIMULATION DEVICE

1. CROSS-REFERENCE TO RELATED APPLICATIONS

This Application is a Section 371 National Stage Application of International Application No. PCT/EP2015/073961, filed Oct. 16, 2015, the content of which is incorporated herein by reference in its entirety, and published as WO 2016/078840 on May 26, 2016, not in English.

2. FIELD OF THE INVENTION

The invention relates to the field of drilling and especially but not exclusively to the field of oil drilling.

The invention can be applied especially for fracturing or fracking geological formations surrounding a well drilled into the ground by the injection of a hydraulic fluid under pressure. It can also be applied for re-fracturing or re-fracking these geological formations in order to retrieve quantities of fluid, produced by this well, that might have not been drained during the initial fracking.

3. PRIOR ART SOLUTIONS

Hydraulic techniques for fracking horizontal wells are widely known and consist of the injection of a fracking fluid into a borehole and conveying this fluid into contact with the formation to be fracked.

Sufficiently high pressure is applied to the fracking fluid to initiate and propagate a fracture in the formation and extract the gas or petroleum from it. Proppants such as, for example, sand or ceramic are generally carried along in this fracking fluid and deposited in the fracture in order to keep it open during production thus enabling the released hydrocarbons to flow up to the surface of the well.

The stimulation of horizontal wells by hydraulic fracking is generally done in several steps in order to create fractures distributed perpendicularly to the horizontal well throughout its length.

It is common practice to implement one of the following two hydraulic fracking methods depending respectively on whether the well is tubed and cemented or tubed but not cemented:

fracking according to the technique known as "plug and perf" in which the fracking procedure is executed sequentially on several intervals of a horizontal well that is tubed and cemented. Starting from the bottom of the well, each interval is perforated, fracked (or stimulated) and isolated by means of a plug before the next interval is processed. Once this procedure has been performed, the plugs can be drilled and the production phase initiated. One drawback of this technique is that it requires a lengthy and difficult cementing operation because it is done in a horizontal well.

fracking known as "open hole multi-stage or OHMS fracking" in which a steel casing is placed within the open well, the casing having sliding sleeves or frac sleeves which are disposed between two isolating packers. These sliding sleeves enable the interior and the exterior of the casing to be put into communication by means of holes or apertures once they occupy a position that does not cover them. These sliding sleeves can be activated by different systems by means of balls that are launched from the surface of the well and strike the sleeves, thus causing them to be moved. One drawback of this technique is that the number of stimulated areas is limited by the number of balls that can be used. In addition, the totality of the area isolated by two packers is exposed to pressure. It is therefore difficult to control the area of initiation and propagation of the fracture.

Other techniques combining sliding sleeves and cemented casings or liners can also be used.

The level of production of gas or petroleum from a well significantly decreases after some years.

It can be decided to re-frack a same well to extend its production period.

Re-fracking is especially sought as a way to augment the penetration of the initial fracture in the formation or develop a new network of fractures and thus extract quantities of petroleum or gas that are still trapped within the rock.

The productivity obtained attains and sometimes surpasses the productivity previously observed during the first fracking. Besides, re-fracking is advantageous in that it does not require the performance of all the operations of well drilling and completion in order to be put it into service, and this limits costs. In other words, it is sometimes more economical to re-frack a well than to drill a new well.

There are different re-fracking techniques. For wells, there have been fracked by what is called the "plug and perf" technique, it is possible to position and cement a new conduit of smaller diameter within the first cemented and fracked conduit and to reiterate the "plug and perf" procedure detailed here above. It is then necessary to ensure cementing quality that sets up tight sealing between the two conduits. The new operations of perforation must also pass through two walls of conduits.

It is also possible to place an expandable sleeve within the first cemented and fractured conduit and reiterate the "plug and perf" procedure described in detail here above. The quality of the tight sealing between the expandable sleeve and the conduit is however vital. One drawback of this approach is that there is a risk that the sleeve will sag during the re-fracking due to generally limited resistance to external pressure for technologies of this type.

4. SUMMARY OF THE INVENTION

According to a first aspect, the invention relates to a method of hydraulic stimulation of the rock of a borehole having an internal casing, the said method comprising the steps of:

positioning a conduit, in the casing of the well, the conduit being provided along its external face, with expandable tubular sleeves, fixedly linked to the conduit, the conduit having at least one aperture before each sleeve to place the internal space of the conduit into communication with the space demarcated by this conduit and each sleeve;

injecting a fluid into said conduit under a first predetermined pressure, this first pressure being sufficient to prompt the expansion of the said sleeves towards the wall of the casing so they get applied against this wall in a tightly sealed way;

the method furthermore comprising, for each of the areas of the wall of the well to be stimulated, the following steps:

putting into position means for plugging the conduit downstream from a first area to be stimulated;

perforating the wall of the conduit and, at least in certain cases, perforating the casing at the first area to be stimulated;

injecting a fluid into said conduit under a second stimulation pressure different from the first pressure, this fluid being intended to surge into the respective apertures of the sleeves situated upstream to the plugging means positioned as well as in the perforations obtained during the perforation at the first area to be stimulated.

The invention proposes a method of hydraulic stimulation of a well by injection, into a conduit carrying several expandable sleeves, of a fluid under very high pressure intended to crack the rock. The conduit is placed in such a way that each area of the well to be stimulated (i.e. each area to be fracked or re-fracked) is situated between sleeves expanded against the wall of the well and mutually defining a confined space.

The conduit is configured in such a way that the same stimulation pressure prevails in the annular volume situated between the external surface of the conduit and the wall of the well at each area to be stimulated and inside the expanded sleeves situated on either side of the annular volume. Thus, the two sleeves demarcate the area to be stimulated.

Such a method can be implemented for applications of hydraulic fracking and re-fracking of the rock of a well (a gas or petroleum well for example).

Through this method, it is possible to carry out highly targeted and short-length fracking and re-fracking operations, in fracking one area at a time, with perfect impervious sealing or tight sealing between the fracked area and the surrounding areas.

It is possible especially to re-frack the areas that have not been sufficiently stimulated during a first fracking operation. In other words, this method increases the penetration of the initial fracture into the formation or develops a new network of fractures.

The method of the invention is carried out in successive phases, the sequencing of the different phases of re-fracking being done from the bottom to the top, i.e. from the downstream side of the well towards the upstream side.

The solution of the invention thus resolves the problems of the prior art and optimizes production simply, efficiently and at little cost.

According to one particular embodiment of the invention, the plugging means are placed downstream from the aperture of the sleeve situated downstream from the area to be stimulated.

According to one particular aspect of the invention, prior to the previous steps, the casing of the well has been perforated in at least one part of said areas and a hydraulic fracking operation has been implemented in the well.

According to one particular aspect of the invention, the sequencing of the steps for the positioning of means of plugging, perforation and injection of the stimulation fluid is done from the downstream side of the well towards the upstream side of the well.

According to one particular aspect of the invention, the step for the positioning of means for plugging the conduit, downstream from the first area of the wall of the well to be stimulated, comprises a step for injecting a ball into the conduit that will get firmly applied in a tightly sealed way against a seat made in proximity to the downstream extremity of the interior wall of the conduit.

According to one particular aspect of the invention, the step for the positioning of means for plugging the conduit, downstream from the first area of the wall of the well to be stimulated, comprises a step for injecting a plug into the conduit intended to get anchored in a tightly sealed way in proximity to the downstream extremity of the interior wall of the conduit.

According to one particular aspect of the invention, the step for the positioning of means for plugging the conduit, downstream from a second area of the wall of the well to be stimulated, comprises a step of injection of a plug within the conduit that is to get anchored in a tightly sealed way into the interior wall of the conduit.

Another aspect of the invention relates to a hydraulic stimulation device to implement the method of hydraulic stimulation of the rock of a borehole having an internal casing as described here above, the device comprising:

a tubular conduit and several expandable tubular sleeves, the opposite extremities of which are connected fixedly and in a tightly sealed way to the external face of said conduit, the wall of the conduit comprising at least one aperture to make the interior of the conduit communicate with the interior of each sleeve;

means of injection into said conduit of a fluid under a first pre-determined pressure, this first pressure being sufficient to prompt the expansion of said sleeves towards the wall of the casing so that they get applied in a tightly sealed way against this wall;

means for plugging the conduit that are to get positioned, downstream from a first area of the wall of the well to be stimulated;

means for perforating the wall of the conduit, and at least in certain cases the wall of the casing, at the first area to be stimulated;

means of injection, into said conduit, of a fluid under a second stimulation pressure, different from the first pressure, this fluid being intended to surge into the respective apertures of the sleeves situated upstream to the plugging means, as well as into the perforations of the wall of the conduit and, and, at least in certain cases, into the perforations of the casing, obtained during the perforation at the first area to be stimulated.

This device can especially be used to stimulate the walls of a well (or rocky formations surrounding a well), a petroleum well for example, drilled in the ground in order to increase the permeability of the wall by formation of vacuums and thus facilitate the draining of the fluid produced by this well, i.e. in order to stimulate production.

This device is adapted to re-stimulating the old fracked portions but also to stimulate the new fracked portions.

Such a device is:

simple to implement, compact, reliable, shows high performance and costs little; and has excellent resistance over time under a wide range of temperatures and pressures.

According to one particular aspect of the invention, the fluid under a second stimulation pressure is further intended to surge into the aperture of the sleeve situated downstream from the area to be stimulated.

According to one particular aspect of the invention, the plugging means comprise a plug bearing tight-sealing means capable of getting applied against the interior wall of the conduit and anchoring means for anchoring said plug into the interior wall of the conduit.

According to one particular aspect of the invention, said plug is fixedly attached to the perforation means.

According to one particular aspect of the invention, the perforation means get detached from said plug once the plug is positioned.

According to one particular aspect of the invention, the perforation means get detached from said plug once the perforations have been made.

According to one particular aspect of the invention, the perforation means carry mobile blocking means to cooperate with the circular grooves made in the interior wall of the conduit.

According to one particular aspect of the invention, a first circular groove is made downstream from the sleeve situated downstream from the area to be stimulated.

According to one particular aspect of the invention, a second circular groove is made upstream to the sleeve situated downstream from the area to be stimulated.

According to one particular aspect of the invention, the interior of the conduit comprises, at its downstream extremity, a seat capable of co-operating with a ball so as to plug said conduit.

According to one particular aspect of the invention, said apertures are equipped with a check valve, a device for plugging the aperture in the event of a flow rate of fluid greater than a pre-determined value, or an overflow valve.

5. LIST OF FIGURES

Other features and characteristics of the invention described shall appear more clearly from the following description of an embodiment, given by way of a simple illustratory and non-exhaustive example, and from the appended drawings of which:

FIGS. 3 and 15 show the successive steps for implementing the method according to the invention, wherein:

FIG. 3 is a longitudinal sectional view of the conduit with a downstream extremity of the conduit being closed;

FIG. 15 is a longitudinal sectional view of the conduit with a fracking fluid again sent into the conduit under a fracking pressure.

6. DESCRIPTION

In the appended figures and purely for the sake of simplification, only a fraction of the horizontal part of borewell A has been shown. It is of course possible for this horizontal portion to extend over a greater length. This portion is attached to a vertical portion leading into the open air, via an intermediate portion substantially shaped like an arc of a circle (not shown). For all the figures, it is considered that the "peak" of the well (which opens into the open air) is situated towards the left of the figures and that its bottom is situated towards to the right.

In all the figures of the present document, the identical elements are designated by a same numerical reference.

Figure 1:
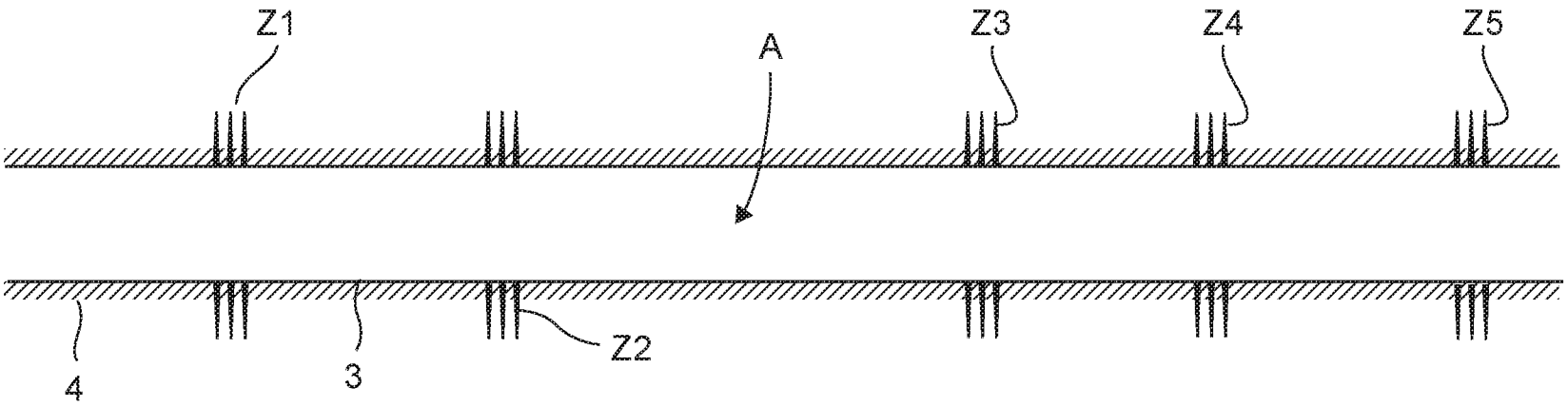
FIG. 1 is a partial schematic view, in a longitudinal section, of the horizontal portion of an oil well in which it is sought to carry out a re-fracking of the rock according to the method of the invention.
Figure 2:
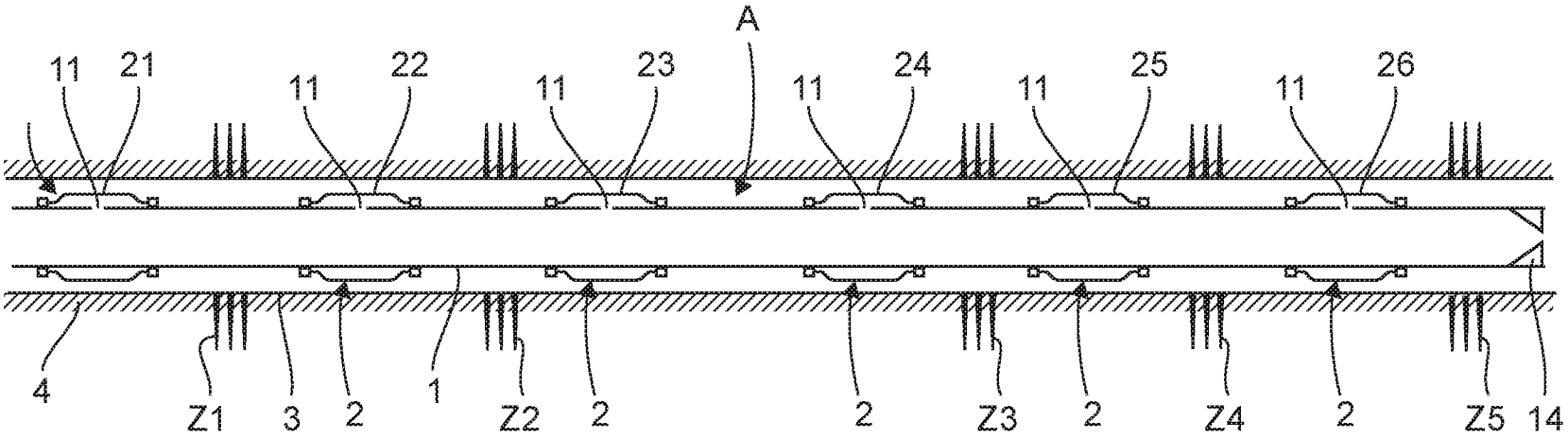
FIG. 2 is the schematic view, along a longitudinal sectional plane, of a part of a tubular conduit forming part of the hydraulic refracking device according to the invention, the device being placed in the interior of the well illustrated in FIG. 1.

FIG. 1 is a schematic view, along a longitudinal sectional plane, of a borehole A that has been fracked a first time and in which it is now sought to carry out a re-fracking of the rock. A casing 3 is disposed in the well A, the annular space 4 between the casing 3 and the formation of the well A being cemented.

The casing 3 can be continuous or formed by a succession of cylindrical steel tubes soldered or screwed to one another end-to-end.

This FIG. 1 shows the hydraulic fracking areas Z1 to Z5 comprising several perforations extending radially in and around the casing 3.

FIGS. 2 to 15 illustrate an example of implementation of the method of hydraulic re-fracking of the tube well A according to the invention.

The first step of this method consists of the positioning, in the well A, of a hydraulic re-fracking device compliant with the invention. The device is shown in FIGS. 2 to 15 but appears only partially in order to facilitate the understanding of the invention.

This device comprises a tubular conduit 1 made of metal that is traditionally positioned inside the horizontal part of the well A.

In practice, this conduit also comprises a vertical upstream extremity that leads into the surface of the well, as well as a curved intermediate portion to connect the vertical part to the horizontal part. This is a tubular conduit formed by several sections placed end-to-end so as to form a completion.

Against the external face of this conduit 1, there extend several isolating devices, each comprising a single cylindrical (or approximately cylindrical) sleeve that is expandable and preferably made of metal. The opposite extremities of each sleeve 21 to 26 are connected fixedly and in a tightly sealed way, by means known per se, to the external face of the conduit 1. About a hundred isolating devices can be provided on the external face of the conduit 1, the spacing or span between two consecutive devices possibly being, for example, of the order of 15 m to 20 m.

In a manner known per se, the tubular conduit 1 comprises at least one aperture 11 that makes this internal space communicate with the interior of each sleeve 21 to 26. Each of the apertures 11 can be provided with a valve system such as a check valve, a system for plugging the aperture 11 in the event of an excessive flow of fluid or an overflow valve.

The conduit 1 is disposed in the well A in such a way that the fracking areas Z1 to Z5 are situated appreciably at mid-distance between two consecutive sleeves. As shall be seen here below, the method of the invention described here below is aimed at refracking the wells Z1 to Z5 and at fracking an area Z6 situated between the sleeves 23 and 24 (the area Z6 has not been previously fracked).

The well is stimulated in successive steps. The sequencing of the different re-fracking phases is done from bottom to top (i.e. from the downstream side of the well towards the upstream side).

It can be noted that the conduit 1 is positioned in the well A with its downstream extremity open, i.e. it is not plugged, to enable the free circulation of fluid present in the well A during this first step. It must be furthermore noted that the sleeves 21 to 26 are in their original state, i.e. not expanded.

An original pressure P0 prevails inside and outside the conduit 1.

Then (FIGS. and 3 and 4) an annular tight sealing is set up between the conduit 1 and the wall of the well A, on either side of each area Z1 to Z5 that is to be re-fracked.

Figure 3:
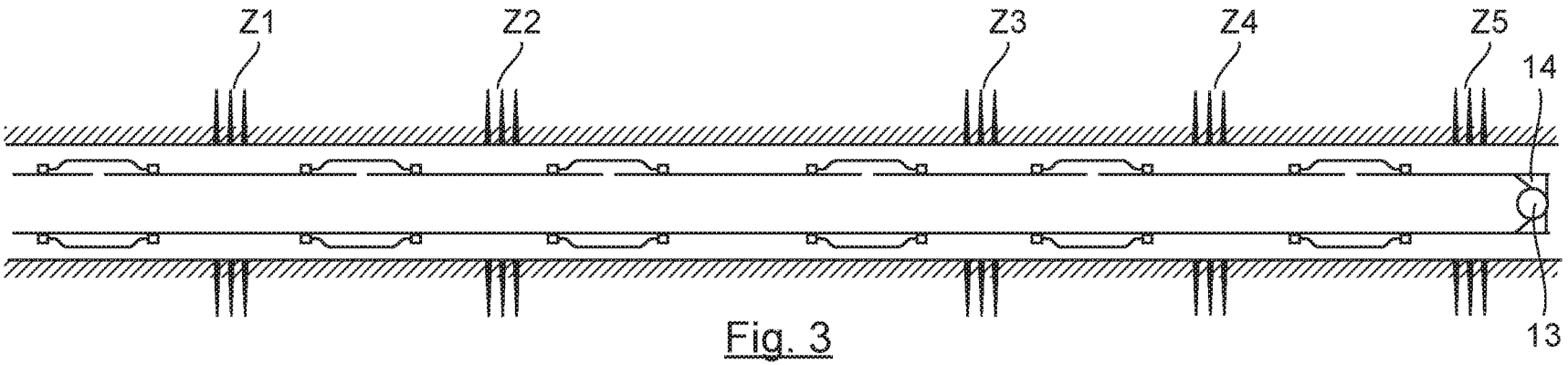

To this end, the downstream extremity of the conduit 1 is closed, (FIG. 3). This closing is carried out by sending a fluid containing a ball 13 that gets applied against a seat 14 made at the open extremity of the conduit 1, thus plugging this conduit. Any other means of plugging of the conduit 1 can be implemented, especially a plug.

Then, into the interior of the conduit 1 and the sleeves 21 to 26, through the apertures 11, a fluid is injected under a pressure P1, greater than P0. This pressure is such that it can give rise to the expansion of the sleeves and can apply the wall of the sleeves 21 to 26 against the interior wall of the casing 3 (FIG. 4) in a tightly sealed way.

Figure 4:
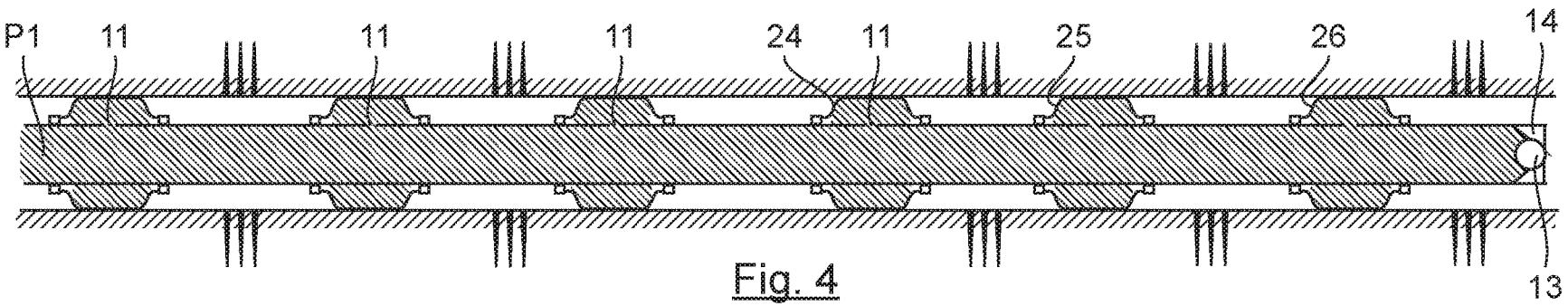
FIG. 4 is a longitudinal sectional view of the conduit with annular sleeves being in an expanded state to form an annular seal.
Figure 5:
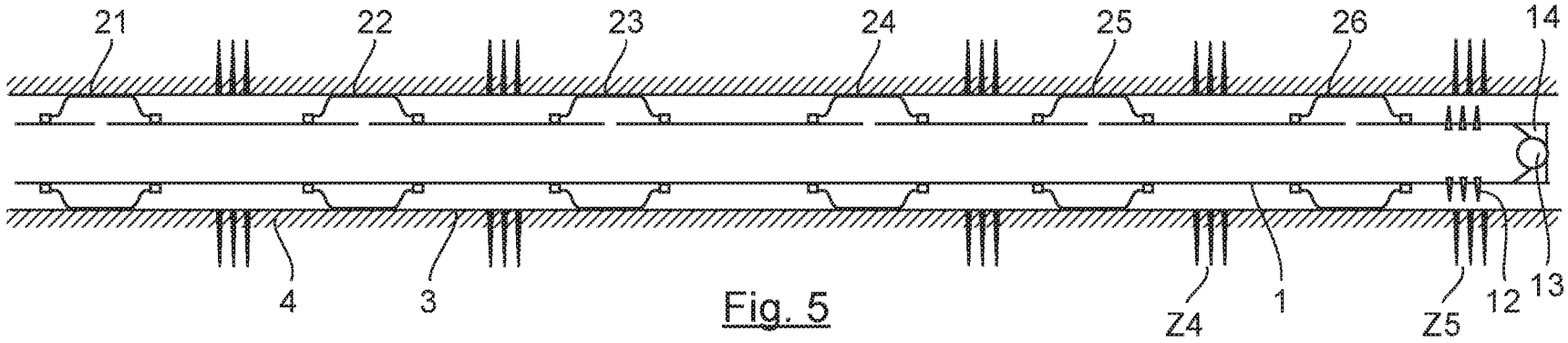
FIG. 5 is a longitudinal sectional view of the conduit being perforated at a height of a fracking area.
Figure 6:
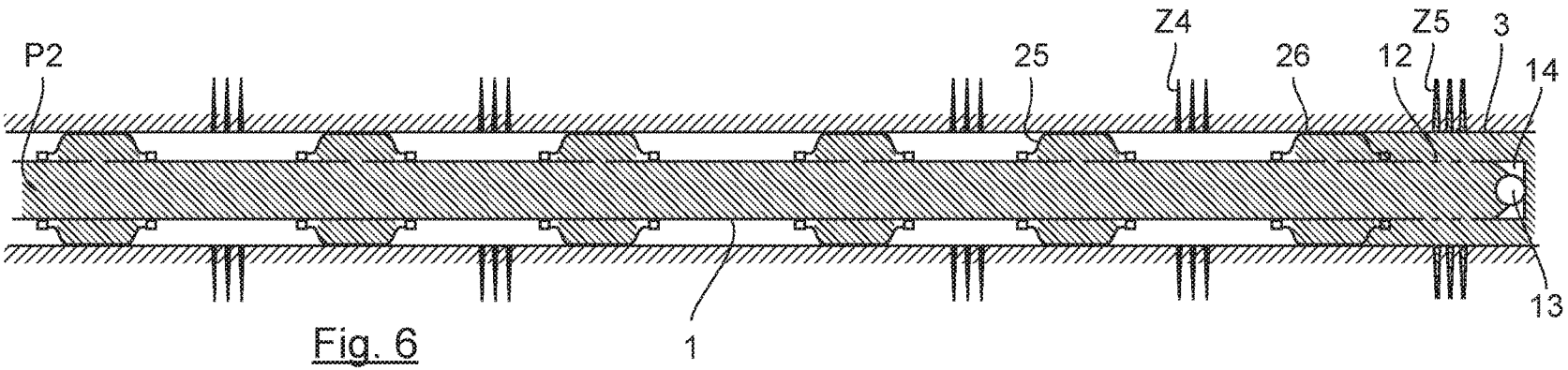
FIG. 6 is a longitudinal sectional view of the conduit with a fracking fluid injected under a fracking pressure into the conduit.

FIG. 4 is a view similar to that of the preceding figure after application inside the conduit of a pressure. The fluid surges into the apertures 11 communicating with the sleeves, the pressure of the fluid being chosen in such a way that it is sufficient to prompt the radial expansion of the sleeves towards the wall of the well A so that they get applied against this wall in a tightly sealed way. When this happens, the pressure P1 prevails inside the sleeves 21 to 26 while, in the space between two consecutive sleeves demarcated by the conduit 1 and the wall of the casing 3, only an original pressure P0 prevails.

After the pressure P1 gets relaxed, while the sleeves 21 to 26 remain expanded and supported against the wall of the well A, the conduit 1 is perforated at the height of the fracking area Z5 (FIG. 5) by means of a classic perforation device (not shown) implemented in the "plug and perf" operations. Several perforations 12 distributed evenly on the periphery of the conduit 1 are then obtained in the wall of the conduit 1. It is by this type of aperture that a fluid under high pressure is conveyed in order to frack the rock.

The perforations can for example be made by means of hollow-charge type explosives. These explosives can be let down into the well by "wireline", "coiled tubing" or again "drill pipe" type tools.

In one alternative, it is possible to provide for a sliding sleeve (not shown) which is moved by the ball 13 in active position and enables the interior and the exterior of the conduit 1 to be put into communication by means of holes or apertures (which are covered by the sleeve in its inactive position).

Then, into the conduit 1, a fracking fluid is injected under a fracking pressure P2 (FIG. 6) different from the pressure P1, from the peak to the bottom, from upstream to downstream. A wellhead is provided to convey the fracking fluid into the well A. Since the conduit 1 is blocked at its downstream extremity by the ball 13, the fracking fluid is directed, via the perforations of the conduit 1, into the annular area situated between the external wall of the periphery 1 and the interior wall of the casing 3, at the area Z5. The fracking pressure P2 is such that it can break the wall of the well A and frack the rock without affecting the sleeve 26.

Figure 7:
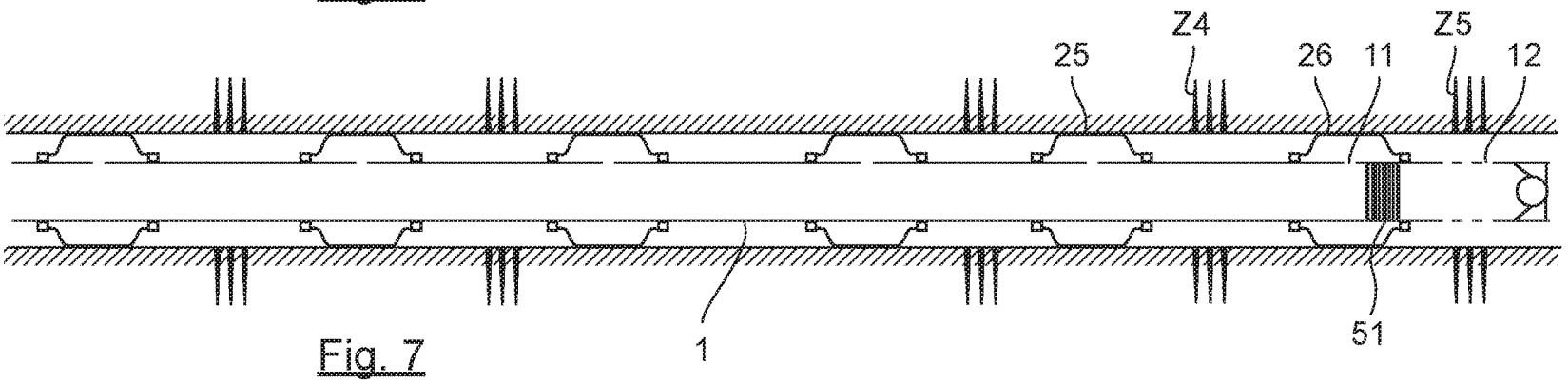
FIG. 7 is a longitudinal sectional view of the conduit with a plug placed in the conduit, once the pressure is relaxed.

As illustrated in FIG. 7, once the pressure P2 is relaxed, a plug 51 is placed in the conduit 1 at the sleeve 26 downstream from the aperture 21 of the sleeve 26 and upstream to the perforations 12 situated at the re-fracturing area Z5.

The plug 51 is, for example, made of composite material and comprises a compressible membrane in the form of a cylindrical sleeve and anchoring teeth situated on either side of the membrane. The compression of the compressible membrane against the wall of the tubing ensures the tight sealing and the positioning of the teeth in a gripping position, so as to ensure that the plug 51 gets anchored in the conduit 1. The body of the plug 51 can be solid and or it can include a longitudinal orifice at its center (thus enabling a circulation of fluid). This orifice is plugged by a ball injected into the conduit 1, once the plug 51 is in position in this conduit. Such plugs can be drilled before the tools are put into production.

Other types of plugs well known to those skilled in the art can however be envisaged.

It can be noted that the sleeves 21 to 26 remain expanded.

Figure 8:
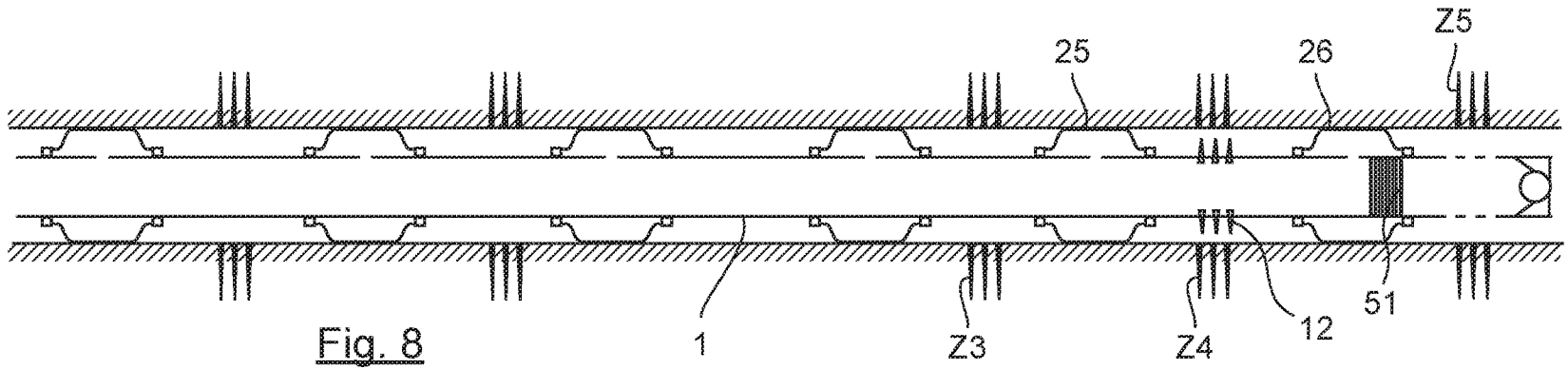
FIG. 8 is a longitudinal sectional view of the conduit with the conduit again perforated at the area situated between two sleeves.

As illustrated in FIG. 8, the conduit 1 is perforated again at the area Z4 situated between the two sleeves 25 and 26 and downstream from the plug 51.

Figure 9:
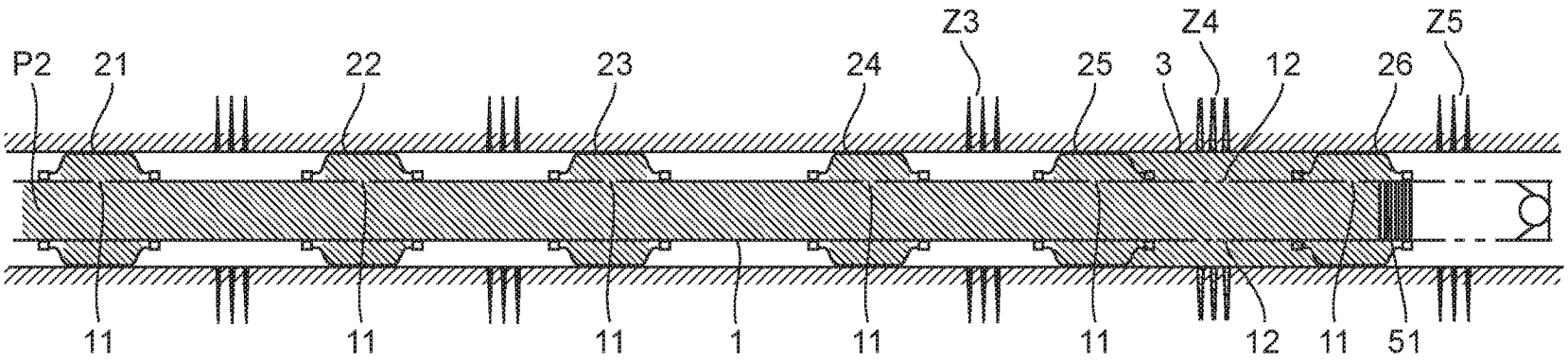
FIG. 9 is a longitudinal sectional view of the conduit with a fracking fluid sent into the conduit under a fracking pressure.

A fracking fluid under a fracking pressure P2 is then sent into the conduit 1 (FIG. 9).

The positioning of the plug 51 enables the passage of the fracking fluid from the interior of the conduit 1 into the internal space of each of the sleeves 21 to 26 via the corresponding aperture 11. The fracking fluid furthermore penetrates the annular space via the perforations 12 situated between the sleeves 25, 26 and the interior wall of the casing 3. Thus the same pressure P2 prevails on either side of the wall of the sleeves 25, 26, and this prevents the collapse of the wall of the sleeves 25, 26 (i.e. within the expanded sleeves 25 and 26 as well as in the annular space situated between the sleeves 25, 26.

It can be noted that the plus 51 prevents the passage of the fracking fluid towards the area Z5 which had been previously re-fracked.

Because no pressure differential exists between the interior of the sleeves 25, 26 and the annular area facing the area Z4 of the wall to be fracked, the fracking is truly localized at this annular wall without any risk of transmission of the fracking to an area that is not facing the one aimed at.

Figure 10:
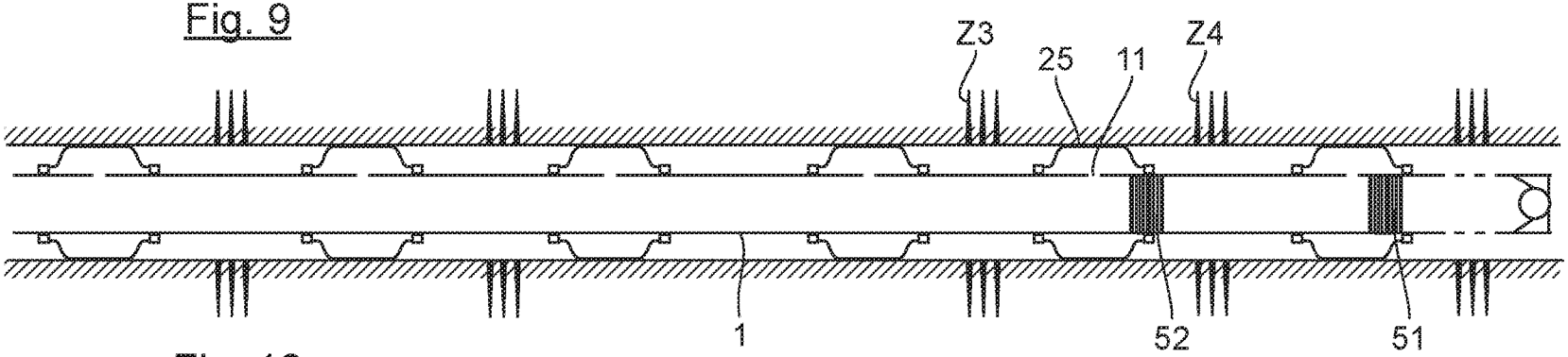
FIG. 10 is a longitudinal sectional view of the conduit with a second plug placed in the conduit upstream to the previously re-fracked area.
Figure 11:
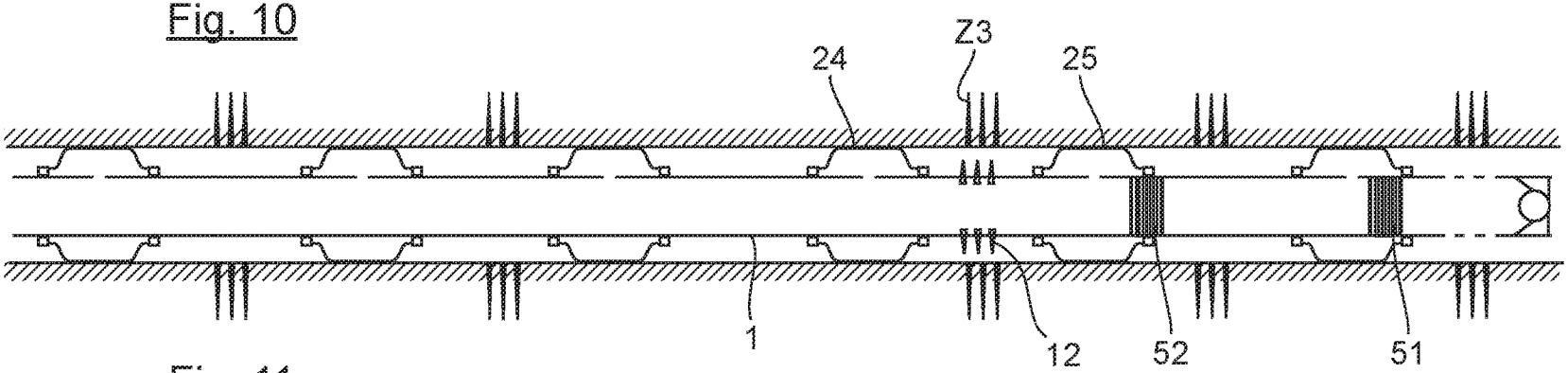
FIG. 11 is a longitudinal sectional view of the conduit with the conduit again perforated at an area situated between two sleeves.
Figure 12:
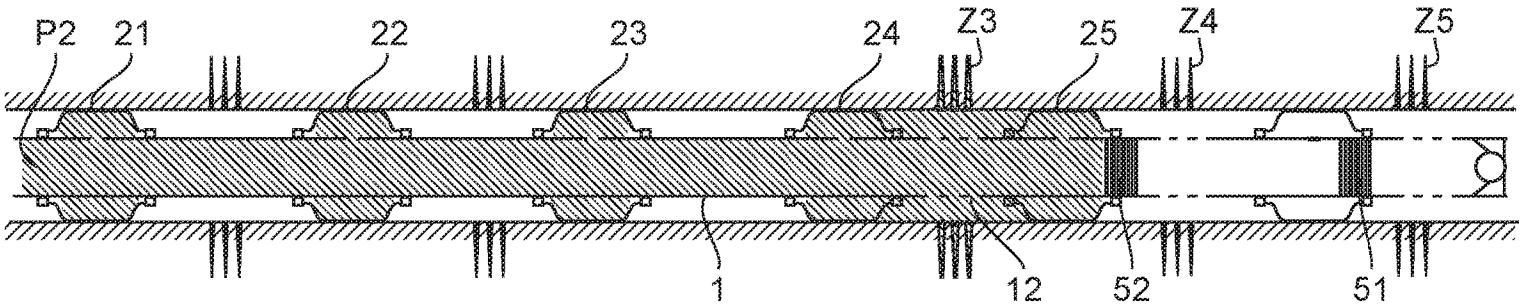
FIG. 12 is a longitudinal sectional view of the conduit with a fracking fluid again sent into the conduit under a fracking pressure.

FIGS. 10 to 12 illustrate the same steps of re-fracking of the area Z3 situated between the sleeves 24 and 25. A second plug 52 is placed upstream to the previously re-fracked area Z4 slightly downstream from the aperture 11 of the sleeve 25 (FIG. 10). Once the wall of the conduit 1 is perforated at the area Z3 (FIG. 11), a fracking fluid surges into the interior of the sleeves 21 to 25 and in the annular structure situated between the sleeves 24 and 25, through the perforations 12 (FIG. 12). The same pressure P2 prevails inside the expanded sleeves 24 and 25 as well as in the annular space situated between the sleeve 24, 25.

Figure 13:
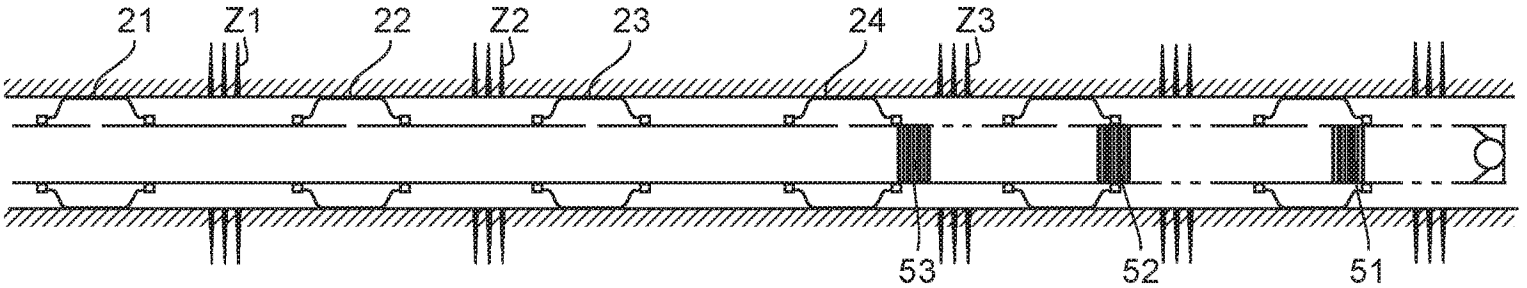
FIG. 13 is a longitudinal sectional view of the conduit with a third plug placed in the conduit upstream to the previously re-fracked areas.
Figure 14:
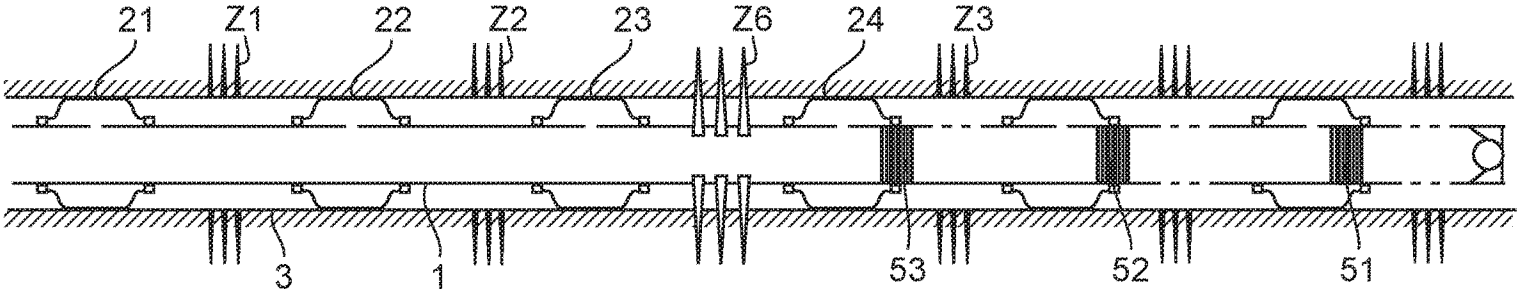
FIG. 14 is a longitudinal sectional view of the conduit with the conduit again perforated at an area situated between two sleeves.
Figure 15:
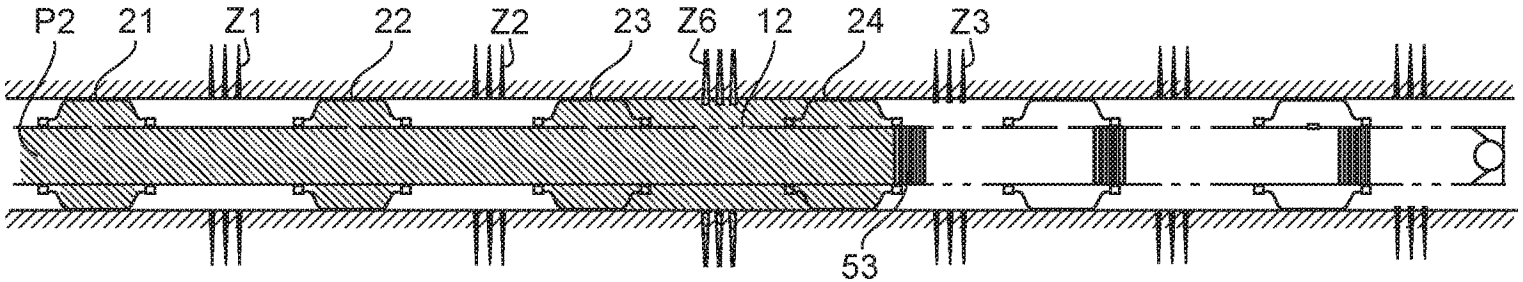

FIGS. 13 to 15 illustrate the steps for fracking the area Z6 situated between the sleeves 23 and 24. A third plug 53 is placed upstream to the area Z3 previously re-fracked and slightly downstream from the aperture 11 of the sleeve 24 (FIG. 13). Once the walls of the conduit 1 and the casing 3 are perforated at the level of the area Z6 to be fracked (FIG. 14), a fracking fluid surges into the interior of the sleeves 21 to 24 and in the annular space situated between the sleeves 23 and 24, through the perforations 12 (FIG. 15). The same pressure P2 prevails within the expanded sleeves 23 and 24 as well as in the annular space situated between these sleeves 23, 24.

Although this is not illustrated in the figures, it can easily be understood that the re-fracking of the area Z2 and then of the area Z1 is implemented according to the same principle as the one described above for the areas Z3 to Z5.

Once these steps of fracking (for the area Z6) and re-fracking (for the areas Z1 to Z5) have been performed, the plugs can be drilled and the well A can be put into production.

The method of the invention can be implemented to frack a cased hole and thus be an alternative to the fracking technique known as "plug and perf" described in the prior art.

The drilled well can be a petroleum well, a gas well or a geothermal well for example.

FIGS. 16 to 19 illustrate a first technique for positioning the perforation device for perforating the conduit 1 (and in certain cases the casing 3) in the conduit 1.

For example, these figures illustrate the positioning of this device at the previously fracked area Z3 which is now to be re-fracked.

Figure 16:
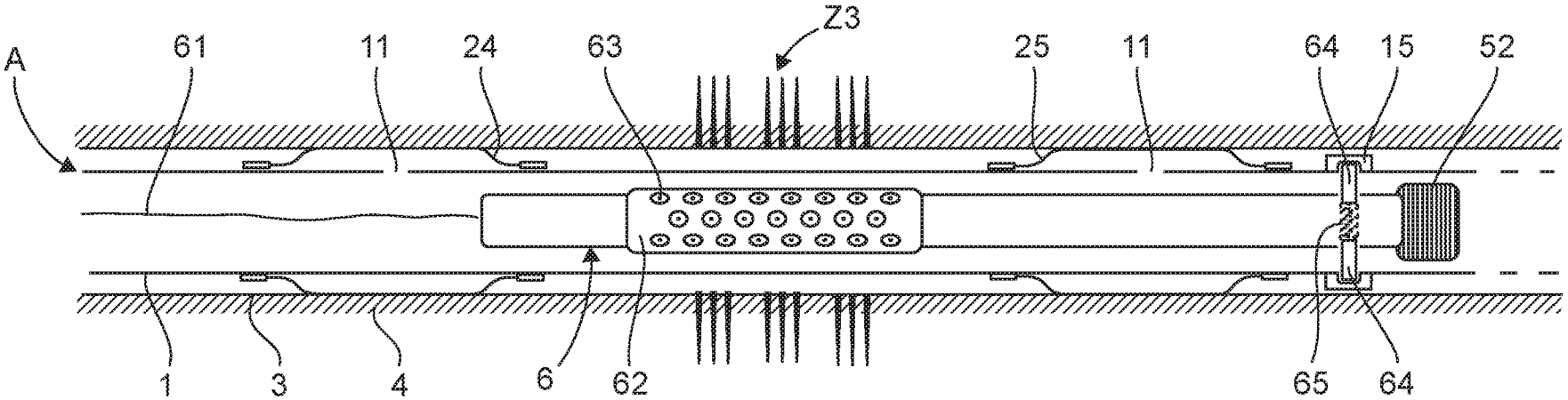
FIGS. 16 to 19 illustrate a first technique of the positioning of the device for perforating the conduit 1 implemented in the method of the invention.

As shown in FIG. 16, the perforation device or perforator 6, which is cylindrical, is let down into the conduit 1 by means of a "wireline" type tool 61.

At its upstream extremity (situated to the left), the perforator 6 comprises a perforation head 62 designed to draw explosive charges perpendicularly towards the exterior through holes 63 perforating the conduit 1 (and the casing 3 for a fracking application) and the rocky formation of the well A.

At its downstream extremity, the perforator 6 has two fingers 64 mobile in a direction perpendicular to the longitudinal axis of the conduit 1 and a plug 52 intended to ensure tight sealing between the area Z3 to be re-fracked and the previously fracked area Z4.

The interior wall of the conduit 1 comprises a circular groove 15, downstream from the sleeve 25 (itself situated downstream from the area Z3), intended to receive the fingers 64 when they are deployed. These fingers 64 are retracted when the perforator 6 is taken down into the well 4 then deployed when they are situated facing the groove 15. This deployment is obtained by a system of springs 65 fixedly attached to each of the fingers 64 and the perforator 6. The positioning of the perforator 6 is then provided (FIG. 16), the perforation tip 62 being situated facing the area Z3 to be re-fracked (or to be fracked for the area Z6), appreciably at mid-distance between the expanded sleeves 24, 25 situated on either side of the area Z3.

Figure 17:
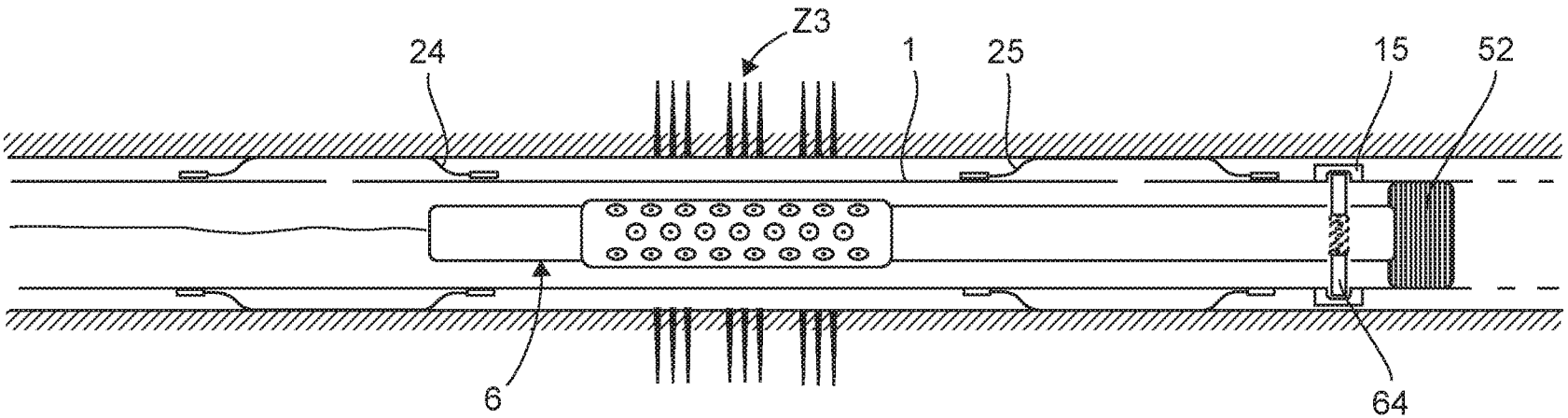
Figure 18:
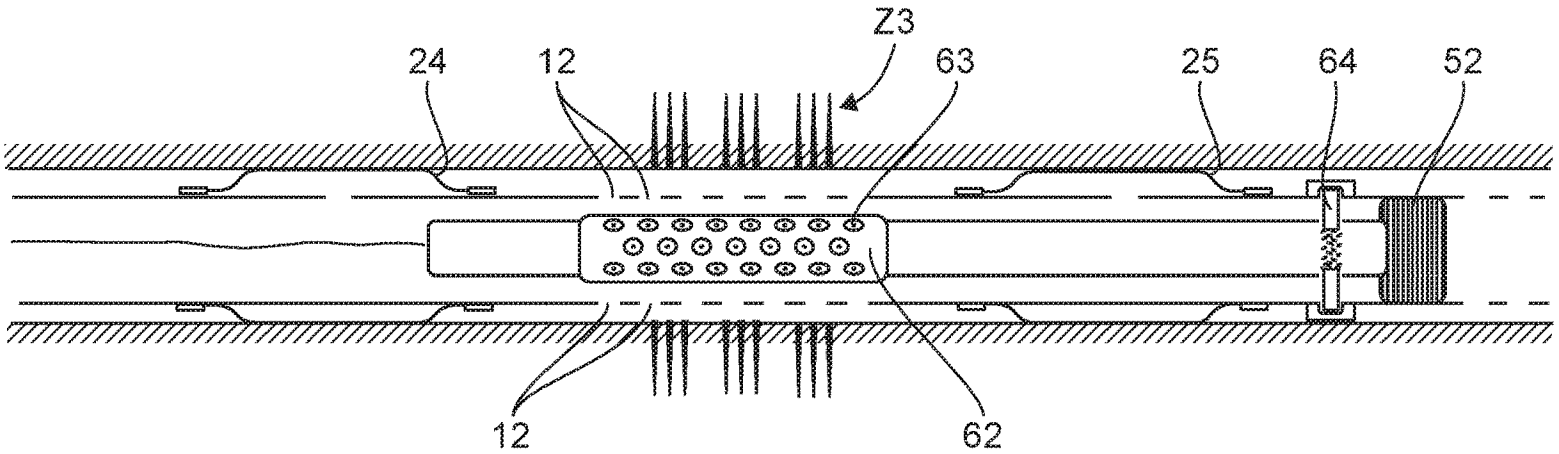

The plug 52 is then expanded and gets anchored in a tightly sealed way in the inner wall of the conduit 1 (FIG. 17). The conduit 1 can then be perforated at the area Z3 by the perforation tip 62, the perforations 12 obtained being visible in FIG. 18.

Figure 19:
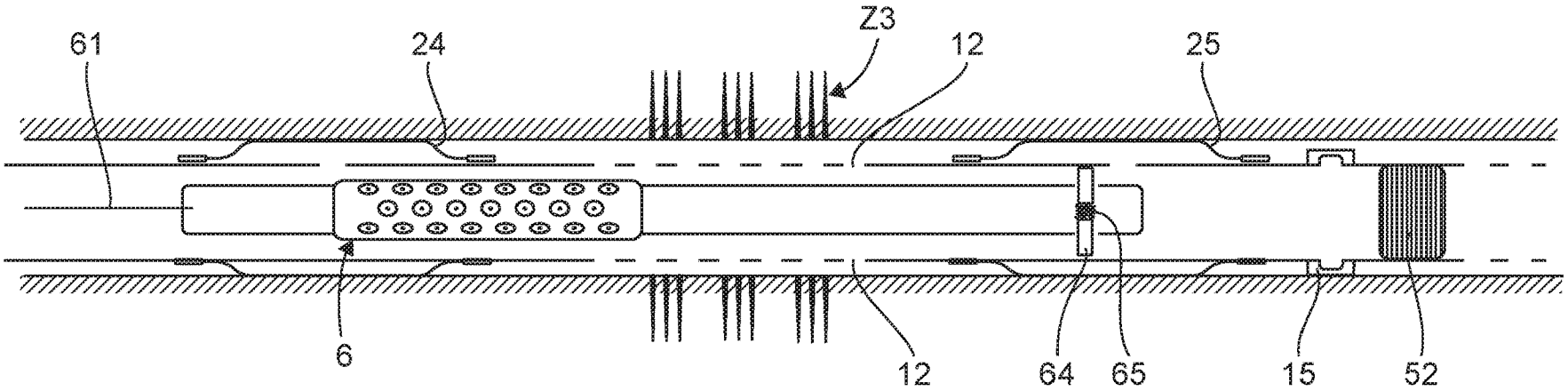

The fingers 64 are then retracted by means of the springs 65 and the perforator 6 is withdrawn from the conduit 1. The perforator 6 gets detached from the plug 52 which remains in position in the conduit 1 (FIG. 19). The area Z3 can then be re-fracked.

It can be understood that the same steps are implemented to isolate and perforate the other areas to be stimulated of the well A from downstream from upstream.

It can be noted that the groove 15 can be advantageously made at the coupling between two assembled portions of the conduit 1.

Figure 20:
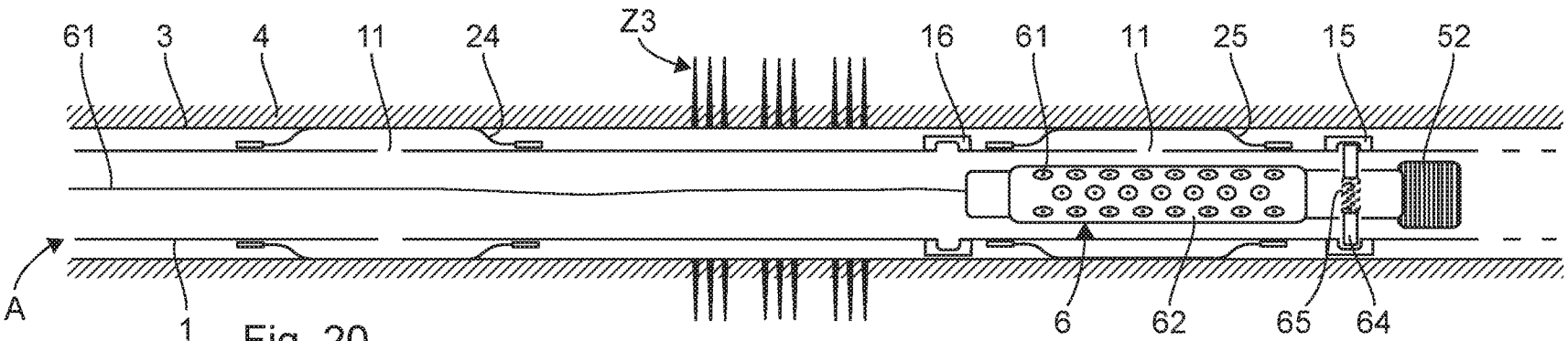
FIGS. 20 to 22 illustrate a second technique of the positioning of the device for perforating the conduit, implemented in the method of the invention.
Figure 21:
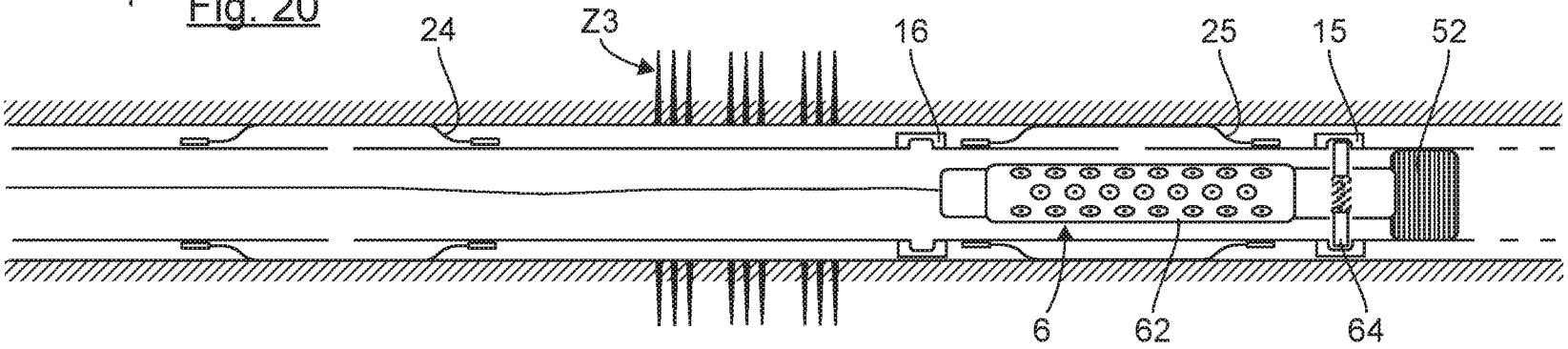
Figure 22:
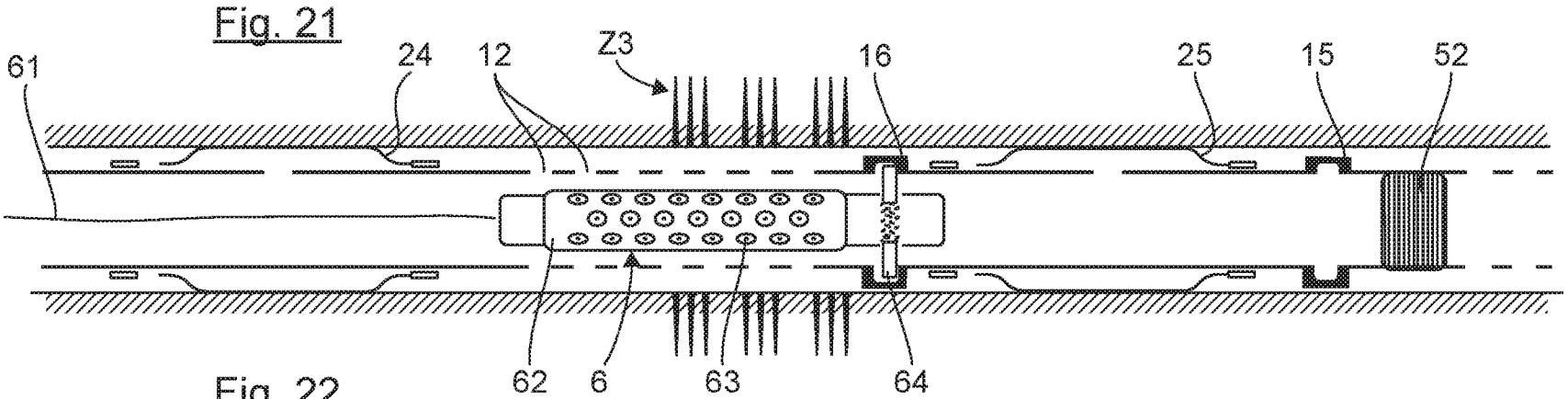

FIGS. 20 to 22 illustrate a second technique for positioning the perforation device of the conduit 1 (and in certain cases that of the casing 3) in the conduit 1 at the previously fracked area Z3, which is to be re-fracked.

As can be seen in FIG. 20, the perforation device or perforator 6 has a smaller length than the one illustrated in FIGS. 16 to 19.

In the same way, the perforator 6 is brought down into the conduit 1 by a wireline type tool 61 and includes a perforation tip 62, two fingers 64 mobile in a direction perpendicular to the longitudinal axis of the conduit 1, and a plug 52 to set up tight sealing between the area Z3 to be re-fracked and the previously re-fracked area Z4.

The inner wall of the conduit 1 comprises a first circular groove 15, downstream, from the sleeve 25 (itself situated downstream from the area Z3) that is to receive the finger 64 when they are deployed. These fingers 64 are retracted when the perforator 6 is brought down into the well A and then deployed when they are situated facing the groove 15. This deployment is carried out by a system of strings 65. The positioning of the perforator 6 is then provided (FIG. 20), the perforation tip 62 being situated so as to be facing the sleeve 25.

The plug 52 is then expanded and gets anchored in a tightly sealed way in the inner wall of the conduit 1 (FIG. 21).

The fingers 64 are then retracted and the perforator 6 is shifted in the conduit 1, upstream. The perforator 6 gets detached from the plug 52 which remains in position in the conduit 1. Once the fingers 64 are situated facing a second circular groove 15, made in the wall of the conduit 1 upstream to the sleeve 25 and downstream from the area Z3, the fingers 64 are deployed and cooperate with the second groove 15 (FIG. 22).

The conduit 1 can then be perforated at the area Z3 by the perforation head 62, the perforations 12 obtained being visible in FIG. 22.

The fingers 64 are then retracted and the perforator 6 is withdrawn from the conduit 1.

It will be understood that the same steps are implemented for (re-)fracking the other areas to be stimulated of the well A, from downstream from upstream, each sleeve downstream from the area to be (re-)fracked being situated between a first and a second groove.

Thus, these two techniques enable a relative positioning of the plugging means (plug 52) and perforation means (perforator 6) relative to the expandable sleeves.

An exemplary embodiment of the present invention is aimed at resolving the drawbacks of the prior art stimulation techniques.

Although the present disclosure has been described with reference to one or more examples, workers skilled in the art will recognize that changes may be made in form and detail without departing from the scope of the disclosure and/or the appended claims.

The invention claimed is:

1. A method of hydraulic stimulation of rock of a borehole of a well having an internal casing, comprising:

positioning a conduit, in the casing of the well, the conduit being provided along its external face, with expandable tubular sleeves, fixedly linked to the conduit, the conduit having, for each sleeve at least one respective aperture to place an internal space of the conduit into communication with a space demarcated by this conduit and the respective sleeve;

injecting a fluid into said conduit under a first pre-determined pressure, this first pressure being sufficient to prompt expansion of the said sleeves towards a wall of the casing, so that the sleeves get applied against the wall of the casing in a tightly sealed way;

and the method comprises for each area of the wall of the well to be stimulated, the following acts:

plugging the conduit at a position downstream from a first area to be stimulated;

perforating a wall of the conduit to create perforations at the first area to be stimulated; and injecting a fluid into said conduit under a second stimulation pressure different from the first pressure, this fluid surging into internal spaces of the sleeves via the respective apertures of the sleeves that are situated upstream to the position of the plugging as well as in the perforations of the wall of the conduit so as to penetrate an annular space situated between the sleeves and the wall of the casing obtained during the perforation at the first area to be stimulated, the same second pressure thus prevailing within the expanded sleeves as well as in the annular space situated between these sleeves so as to prevent collapse of a wall of the sleeves.

2. The method of hydraulic stimulation according to claim 1, wherein the position of the plugging is downstream from the aperture of the sleeve situated downstream from the area to be stimulated.

3. The method of hydraulic stimulation according to claim 1 wherein, prior to the acts of claim 1, the casing of the well has been perforated in at least one part of said areas and a hydraulic fracking operation has been implemented in the well.

4. The method of hydraulic stimulation according to claim 1, wherein a sequencing of the act of plugging, perforating and injecting the stimulation fluid is done from a downstream side of the well towards an upstream side of the well.

5. The method of hydraulic stimulation according to claim 1, wherein the act of plugging the conduit, downstream from the first area of the wall of the well to be stimulated, comprises injecting a ball into the conduit that is to get firmly applied in a tightly sealed way against a seat made in proximity to a downstream extremity of an interior wall of the conduit.

6. The method of hydraulic stimulation according to claim 1, wherein the act of plugging the conduit, downstream from the first area of the wall of the well to be stimulated, comprises injecting a plug into the conduit that will get anchored in a tightly sealed way in proximity to a downstream extremity of an interior wall of the conduit.

7. The method of hydraulic stimulation according to claim 6, wherein the act of plugging the conduit, downstream from a second area of the wall of the well to be stimulated, comprises injecting a plug within the conduit that is to get anchored in a tightly sealed way into an interior wall of the conduit.

8. A hydraulic stimulation device to hydraulically stimulate rock of a borehole of a well having an interior casing, wherein the hydraulic stimulation device comprises:

a tubular conduit and several expandable tubular sleeves, wherein opposite extremities of which are connected fixedly and in a tightly sealed way to an external face of said conduit, a wall of the conduit comprising, for each sleeve, at least one aperture to make an interior of the conduit communicate with an interior of that respective sleeve;

means for injecting into said conduit a fluid under a first pre-determined pressure, this first pressure being sufficient to prompt expansion of said sleeves towards a wall of the casing so that the sleeves get applied in a tightly sealed way against the wall of the casing;

means for plugging the conduit positioned downstream from a first area of a wall of the well to be stimulated;

means for perforating the wall of the conduit to create perforations at the first area to be stimulated;

a wellhead provided to convey, into said conduit, a fluid under a second stimulation pressure, different from the first pressure, such that the fluid under the second pressure surges into internal spaces of the sleeves via the respective apertures of the sleeves that are situated upstream to the means for plugging, as well as into the perforations of the wall of the conduit so as to penetrate an annular space situated between the sleeves and the wall of the casing obtained during the perforation at the first area to be stimulated, the same second pressure thus prevailing within the expanded sleeves as well as in the annular space situated between these sleeves so as to prevent collapse of a wall of the sleeves.

9. The hydraulic stimulation device according to claim 8, wherein the fluid under a second stimulation pressure further surges into the aperture of the sleeve situated downstream from the area to be stimulated.

10. The hydraulic stimulation device according to claim 8, wherein the plugging means comprise a plug bearing tight-sealing means capable of getting applied against an interior wall of the conduit and anchoring means for anchoring said plug into the interior wall of the conduit.

11. The hydraulic stimulation device according to claim 10, wherein said plug is fixedly attached to the means for perforating.

12. The hydraulic stimulation device according to claim 11, wherein the means for perforating get detached from said plug once the plug is positioned.

13. The hydraulic stimulation device according to claim 12, wherein the means for perforating get detached from said plug once the perforations have been made.

14. The hydraulic stimulation device according to claim 8, wherein the means for perforating carry mobile blocking means to cooperate with circular grooves made in the interior wall of the conduit.

15. The hydraulic stimulation device according to claim 14, wherein a first circular groove is made downstream from the sleeve situated downstream from the area to be stimulated.

16. The hydraulic stimulation device according to claim 15, wherein a second circular groove is made upstream to the sleeve situated downstream from the area to be stimulated.

17. The hydraulic stimulation device according to claim 8, wherein the interior of the conduit comprises, at its downstream extremity, a seat capable of cooperating with a ball so as to plug said conduit.

18. The hydraulic stimulation device according to claim 8, wherein said apertures are equipped with a check valve, a device that plugs the aperture in the event of a flow of fluid greater than a pre-determined value or an overflow valve.

* * * * *